United States Patent [19]

Raeckelboom

[11] Patent Number: 4,552,321

[45] Date of Patent: Nov. 12, 1985

[54] STRAND GUIDE

[76] Inventor: Marc A. Raeckelboom, Rte. 3, Box 501, Simpsonville, S.C. 29681

[21] Appl. No.: 577,490

[22] Filed: Feb. 6, 1984

[51] Int. Cl.[4] ..... B65H 49/02; D03J 5/08

[52] U.S. Cl. ..... 242/130; 242/131; 242/140; 242/157 R

[58] Field of Search ..... 242/129.62, 129.72, 242/129.7, 130, 130.1, 140, 157 R; 57/352–354

[56] References Cited

U.S. PATENT DOCUMENTS

| | | | |
|---|---|---|---|
| 3,304,026 | 2/1967 | Bucklow et al. | 242/131 |
| 3,850,394 | 11/1974 | Raasch et al. | 242/129.7 |
| 3,858,827 | 1/1975 | Glassbrook | 242/131 |

*Primary Examiner*—Leonard D. Christian
*Attorney, Agent, or Firm*—Bailey & Hardaway

[57] ABSTRACT

A guide is illustrated for positioning packages for carrying yarn including thread and the like upon a creel wherein an elongated package positioning member has an outer surface tapering inwardly toward an end which is insertable within the package, said elongated package positioning member having a longitudinal bore which is loosely receivable upon an elongated package positioning member on a creel. An offset support is carried by each of the package positioning members for supporting a yarn guide for feeding yarn from the packages to a consuming machine.

5 Claims, 4 Drawing Figures

STRAND GUIDE

BACKGROUND OF THE INVENTION

This invention relates to guides for all types of strands or yarns including thread and the like. Heretofore, the positioning of thread spools and the like upon upright creels has been difficult due to problems of accessability as well as firm positioning upon the creel. Heretofore, packages must be of limited size and such are difficult to dismantle as well as install. For example, it is difficult to clean behind the plates which carry the elongated package supports as well as yarn guides such as are used in embroidery machines, for example, embroidery machines supplied by Saurer Corporation Textile Machinery of Greenville, S.C.

The prior art is represented by a creel having vertically spaced bars for carrying packages such as illustrated in U.S. Pat. No. 3,858,827. U.S. Pat. No. 3,850,394 illustrates a tapered surface snugly receiving an end of a yarn carrier having an internal opening.

Accordingly, it is an important object of this invention to provide a strand guide to facilitate the creeling of packages so as to increase the size of carrier including spools, tubes and the like.

Another important object of the invention is to provide a creeling apparatus permitting larger packages which may be installed and dismantled easily.

SUMMARY OF THE INVENTION

It has been found that a yarn guide and the like may be provided which includes an elongated package positioning member having a tapered surface for snugly positioning the yarn package for reception upon a creel which includes vertically spaced horizontal bars while at the same time positioning an offset support for a guide such as a pigtail guide.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a creel for supporting a plurality of yarn packages having a tubular core member including an upright frame A having a plurality of spaced outwardly projecting elongated members B for loosely receiving the tubular core member of the yarn packages. Elongated package positioning members each have an outer surface C tapering inwardly toward an insertable end receivable within the tubular core member for snugly receiving the package thereon. A longitudinal bore within the elongated package positioning member is loosely receivable upon the spaced outwardly projecting elongated members. An offset support D is carried by each of the package positioning members remote from the insertable ends supporting a yarn guide for feeding yarn from the packages.

Figure 1:
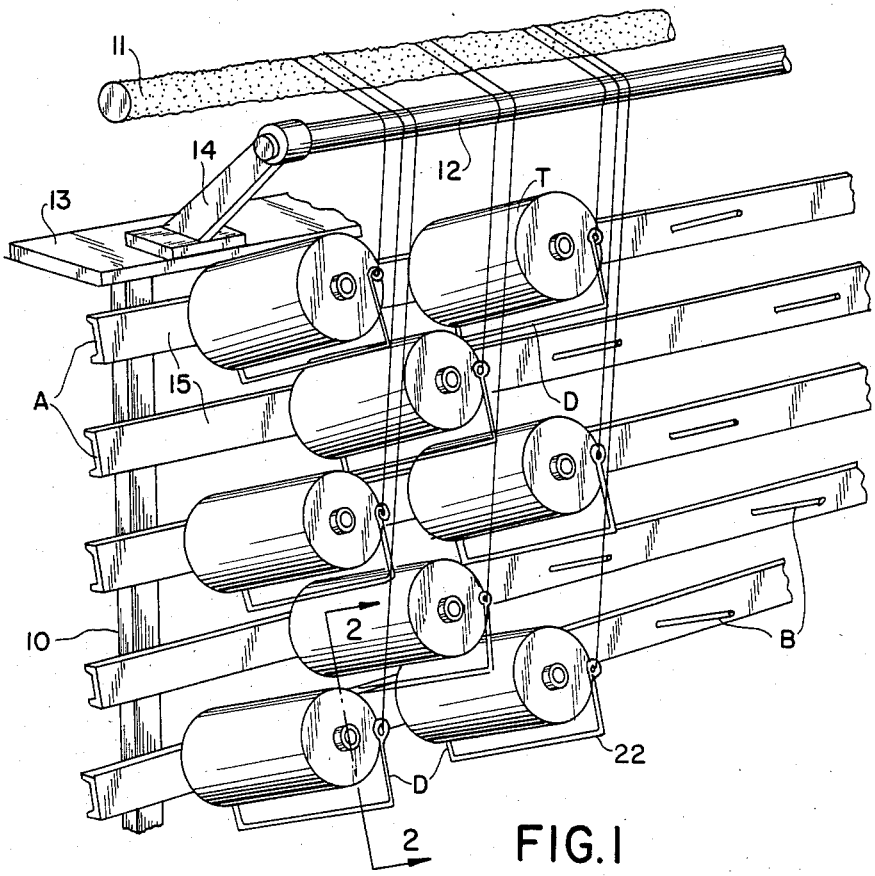
FIG. 1 is a perspective view illustrating an upright creel carried in front of a consuming machine such as an embroidery machine having the usual plush roll.

FIG. 1 illustrates a creel having an upright frame A which includes a number of vertically spaced bars carrying outwardly projecting members B for positioning upon a vertical spaced bar 10 upon an embroidery machine of the type manufactured by Saurer Corporation Textile Machinery. The embroidery machine includes the usual plush roll 11 and guide roll 12 positioned upon a frame member 13 upon brackets 14. The creel includes vertically spaced bars in the form of inwardly turned channel members having vertical legs for carrying the outwardly projecting elongated members B.

Figure 2:
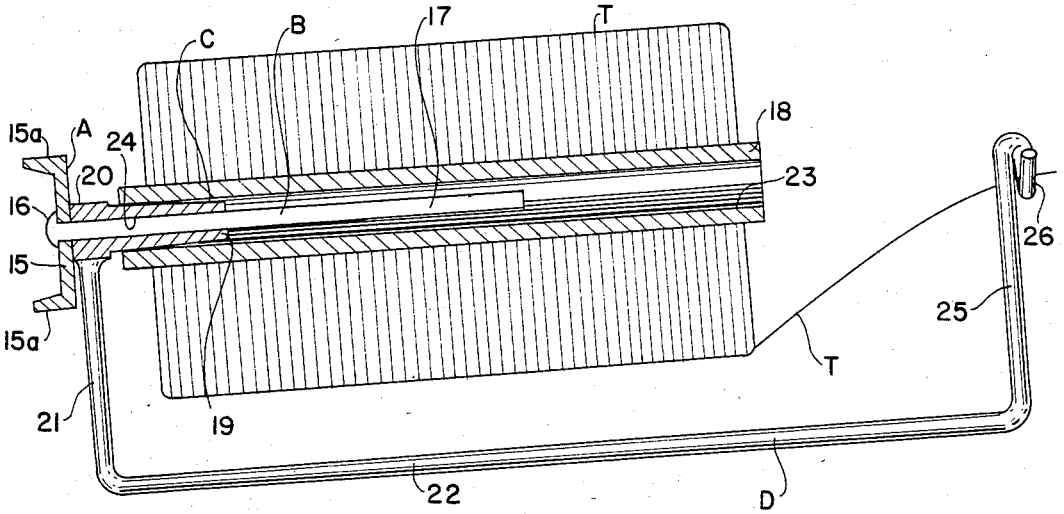
FIG. 2 is an enlarged longitudinal sectional elevation taken on the line 2—2 in FIG. 1.

According to the invention, the elongated package positioning member provides an outer surface C which tapers inwardly accurately positioning the spool permitting larger packages which may be heavier and which supply a strand to the consuming machine over a long period of time without further creeling. Such positioning of the guide permits the use of larger packages to be spaced alternately in adjacent rows as illustrated by the positions of the outwardly projecting elongated members B in FIG. 1. The members B projects outwardly from the back of the web portions 15 of the bars A. Enlarged heads 16 of the members B are carried between the inwardly projecting legs **15*a* of the bars A, FIGS. 2 and 4. The outwardly projecting elongated members B each have a blade portion 17 which extends through an opening within the web member 15 for securing a tubular core member 18 of the strand package thereon. In order to avoid wobbling movement of the elongated core member upon the blade 17, an elongated package postioning member has an outer surface C which tapers inwardly toward an insertable end designated at 19 in FIG. 2**.

The surface C tapers outwardly toward a collar 20 carried opposite the insertable end 19 for positioning the offset member D thereon. The offset member D includes an offset rod or wire portion 21 which has integral or otherwise fixed connection to the collar 20 on one end and carries a longitudinal projection 22 which generally follows the axis of the tubular core 23 of the tubular core member 18. Preferably, parallel with this axis is a longitudinal bore 24 carried within in the elongated package positioning members having the tapered surface C. The longitudinal portion 22 of the guide has an inwardly directed segment 25 which carries a guide which may be an integral pigtail guide as best illustrated at 26 in FIG. 2.

Figure 3:
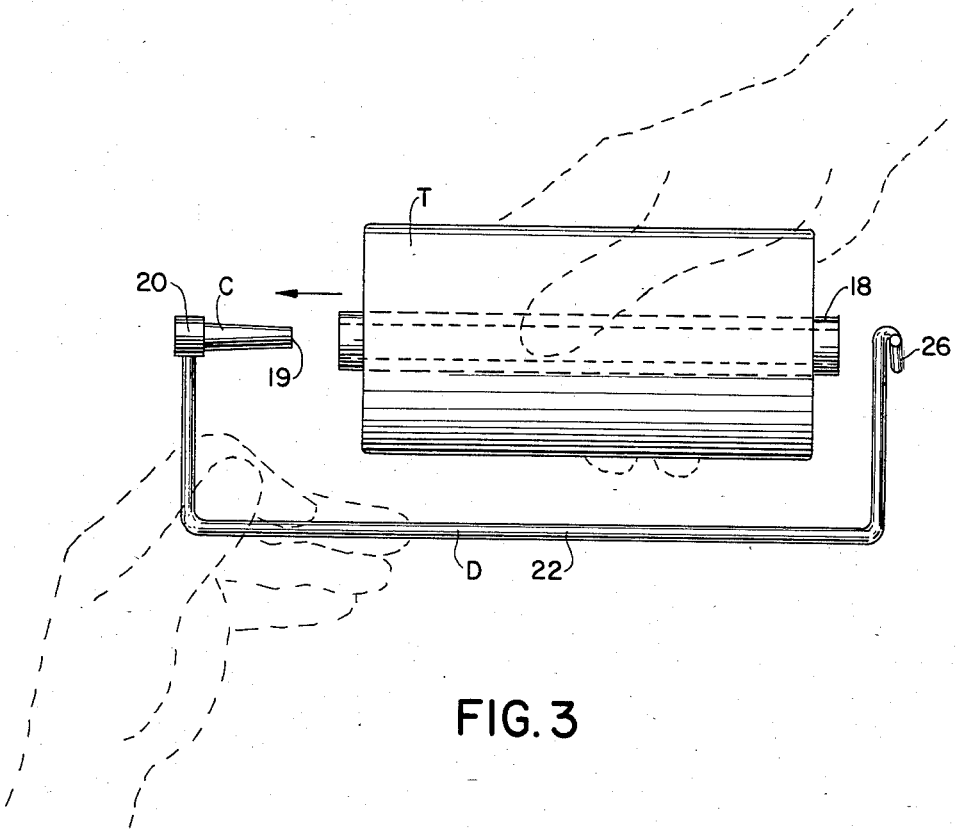
FIG. 3 is a side elevation illustrating a yarn or thread guide constructed in accordance with the present invention upon which a spool containing thread is being positioned for in turn positioning same upon an upright creel such as in FIG. 1.

Referring more particular now to FIG. 3, the thread T is illustrated as a package wound upon the core 18 having the longitudinal bore for reception upon the tapered surface C. It will be noted that the yarn packaging is easily accommodated between the insertable end 19 and the pigtail guide 26.

Figure 4:
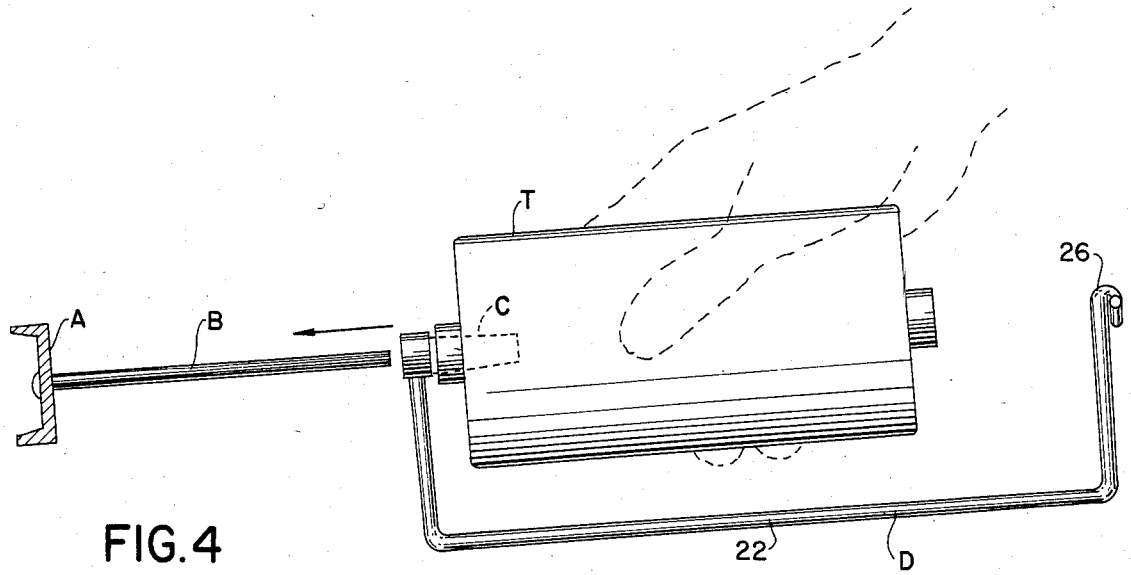
FIG. 4 is a side elevation illustrating the strand guide as snugly receiving a yarn package with the assembly being inserted upon an outwardly projecting elongated member carried upon the vertically spaced bars forming the creel.

FIG. 4 illustrates the assembly which includes the package T being carried upon the strand guide hereof for reception of the bore of the strand guide upon the projecting members B of the creel.

While a preferred embodiment of the invention has been described using specific terms, such description is for illustrative purposes only and it is to be understood that changes and variations may be made without departing from the spirit or scope of the following claims.

What is claimed is:

1. A creel for supporting a plurality of yarn packages having a tubular core member comprising:

an upright frame having a plurality of spaced outwardly projecting elongated members for loosely receiving said tubular core member of said yarn packages;

elongated package positioning members each having an outer surface tapering inwardly toward an insertable end receivable within said tubular core member for snugly receiving said package thereon;

a longitudinal bore within each said elongated package positioning member loosely receivable upon said spaced outwardly projecting elongated members; and an offset support carried by each of said package positioning members remote from said insertable ends supporting a yarn guide for feeding yarn from said packages.

2. A thread guide assembly for use in carrying spools of thread upon a creel for consumption by a machine comprising:

an elongated spool positioning member having an outer surface tapering inwardly toward an insertable end receivable within said spool for snugly receiving said spools thereon;

a longitudinal bore within said elongated spool positioning member receivable upon the spaced projections of a creel; and an offset support carried by said spool positioning member remote from said insertable end supporting a guide for feeding thread from said packages.

3. The thread guide assembly set forth in claim 2 wherein said longitudinal bore is loosely receivable upon a creel.

4. The thread guide assembly set forth in claim 3 wherein said support is integral with said spool positioning member, and said guide is integral with said support.

5. A thread guide assembly for use in carrying spools of thread upon a creel for consumption by a machine, said thread guide and creel comprising:

an elongated spool positioning member having an outer surface tapering inwardly toward an insertable end receivable within said spool for snugly receiving said spools thereon;

a longitudinal bore within said elongated spool positioning member receivable upon the spaced projections of a creel;

an offset support carried by said spool positioning member remote from said insertable end supporting a guide for feeding thread from said packages; and a plurality of vertically spaced bars for positioning said spaced projections positioned in front of the consuming machine.

* * * * *